United States Patent [19]

McGlashan

[11] 4,429,293

[45] Jan. 31, 1984

[54] PINCUSHION RASTER CORRECTOR DISTORTION WITH IMPROVED PERFORMANCE

[75] Inventor: Kenneth W. McGlashan, Indianapolis, Ind.

[73] Assignee: RCA Corporation, New York, N.Y.

[21] Appl. No.: 494,468

[22] Filed: May 13, 1983

[51] Int. Cl.[3] ..... H01F 7/00

[52] U.S. Cl. ..... 335/211; 335/210; 313/421; 313/431

[58] Field of Search ..... 335/210, 211, 212; 313/421, 425, 426, 427, 428, 429, 430, 431

[56] References Cited

U.S. PATENT DOCUMENTS 4,257,023 3/1981 Kamijo ..... 335/211
4,357,586 11/1982 Barkow ..... 335/211

FOREIGN PATENT DOCUMENTS 2079527 1/1982 United Kingdom ..... 313/421

*Primary Examiner*—George Harris

*Attorney, Agent, or Firm*—Paul J. Rasmussen; Joseph Laks; Scott J. Stevens

[57] ABSTRACT

A television display system includes a kinescope producing an electron beam and a deflection yoke for deflecting the electron beam to form a raster on a display screen of the kinescope. A field forming apparatus is located external to the yoke for correcting side pincushion distortion of the raster on the kinescope display screen. The field forming apparatus comprises a pair of magnetically permeable flux gathering members located on opposite sides of the yoke within the stray field produced by the vertical deflection coils of the yoke. Flux channeling members carry the flux from the flux gathering members to flux directing members at the front of the yoke where the appropriate distortion correction field is formed. The flux channeling members include a part that extends perpendicular to the kinescope so as to place the flux directing members close to the funnel of the kinescope in order to generate a field of sufficient intensity to provide the desired amount of pincushion distortion correction.

7 Claims, 3 Drawing Figures

PINCUSHION RASTER CORRECTOR DISTORTION WITH IMPROVED PERFORMANCE

Figure 1:
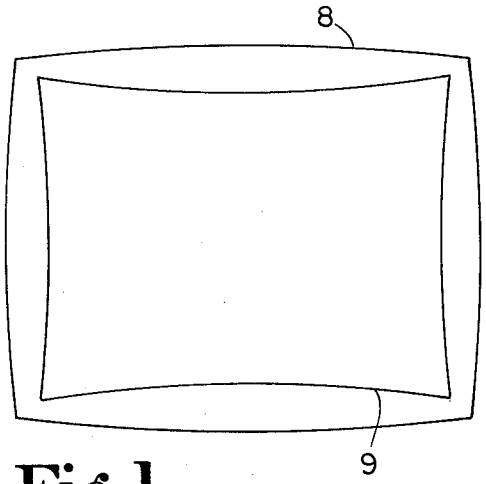

This invention relates to pincushion raster distortion correction for television receivers and, in particular, to pincushion correction devices which modify external fields of the receiver deflection yoke.

The shape and contour of the front panel of a typical picture tube or kinescope of a television receiver causes the deflection electron beam or beams to traverse a greater distance to the corners of the display screen than to the screen sides. This causes the raster scanned by the beam or beams to be pincushion shaped, i.e., the sides of the raster being bowed inward with respect to the corners.

Correction of this distortion may be accomplished by electronic circuits which change the deflection current in a time-varying manner in order to cause the electron beam deflection to compensate the raster distortion. For example, the horizontal deflection current can be changed at the vertical deflection rate in order to correct pincushion distortion at the sides of the screen. These correction circuits, however, increase the cost and complexity of the receiver and may increase receiver power dissipation.

Color television receivers typically include a self-converging display system which incorporates a kinescope having an electron gun assembly that produces three horizontally aligned electron beams and a deflection yoke which converges the kinescope electron beams on the display screen without the need for dynamic convergence circuits. In order to accomplish this, the deflection yoke incorporates horizontal and vertical deflection coils which have winding distributions that produce deflection fields having nonuniform field gradients in the electron beam deflection region. It is known that proper beam convergence requires the horizontal deflection coils to produce a pincushion shaped field (as viewed along the kinescope longitudinal axis) and the vertical deflection coils to produce a barrel shaped field. It is also known that causing localized changes in the deflection field nonuniformity along the kinescope longitudinal axis may aid in the correction of some forms of raster distortion.

A localized pincushion shaped vertical deflection field near the front or beam exit end of the deflection yoke aids in the correction of the previously described side pincushion raster distortion. This pincushion shaped field can be produced by locally varying the winding distribution of the vertical coils (e.g., by biasing the individual coil turns). However, the coils must produce an overall net barrel shaped field in order to converge the beams. Coils that provide proper beam convergence in addition to pincushion raster distortion correction may be difficult to manufacture efficiently and economically.

U.S. Pat. No. 4,257,023, issued Mar. 17, 1981, in the name of N. Kamijo, and entitled, "Deflecting Device for Cathode-Ray Tube", discloses a magnetically permeable structure which is mounted near the front of the yoke in order to provide side pincushion raster distortion correction. The disclosed structure provides a low reluctance path for leakage flux from the vertical deflection coils. The leakage flux is conducted to feet-like members at the front of the yoke. A pincushion shaped field is formed between the feet-like members which acts to correct side pincushion distortion.

By itself, the field produced by this "cross arm" structure may be insufficient to provide the necessary pincushion distortion correction. In that case, modification in the vertical coil winding distribution may be required, which may result in an undesirable increase in the cost and complexity of the deflection yoke.

The present invention is directed to a pincushion raster distortion corrector that provides an improvement in the amount of pincushion distortion correction, as compared to the structure described in the previously described patent, thereby reducing or eliminating modifications in the vertical deflection coil winding distribution.

In accordance with an aspect of the present invention, a television display system comprises a kinescope having a neck, an electron gun assembly for producing an electron beam located in the neck, a display screen, a funnel located intermediate the neck and the display screen. A deflection yoke, mounted on the kinescope neck, incorporates horizontal and vertical deflection coils that, when connected to a source of deflection signals, produce deflection fields inside the yoke and stray fields outside the yoke.

A field shaping apparatus comprises magnetically permeable flux gathering members located on opposite sides of the yoke in the region of the stray field and providing a low reluctance path for stray field flux. Flux directing members extend along and adjacent to the surface of the kinescope funnel for forming an electromagnetic field between the flux directing members on opposite sides of the yoke. Flux channeling members are connected between the flux gathering members and the flux directing members providing a low reluctance flux path from the flux gathering members to the flux directing members. Part of the flux channeling members is disposed parallel to the kinescope longitudinal axis and part is disposed transverse to the axis and extends toward the kinescope funnel in order to intensify the field formed between the flux directing members.

Figure 2:
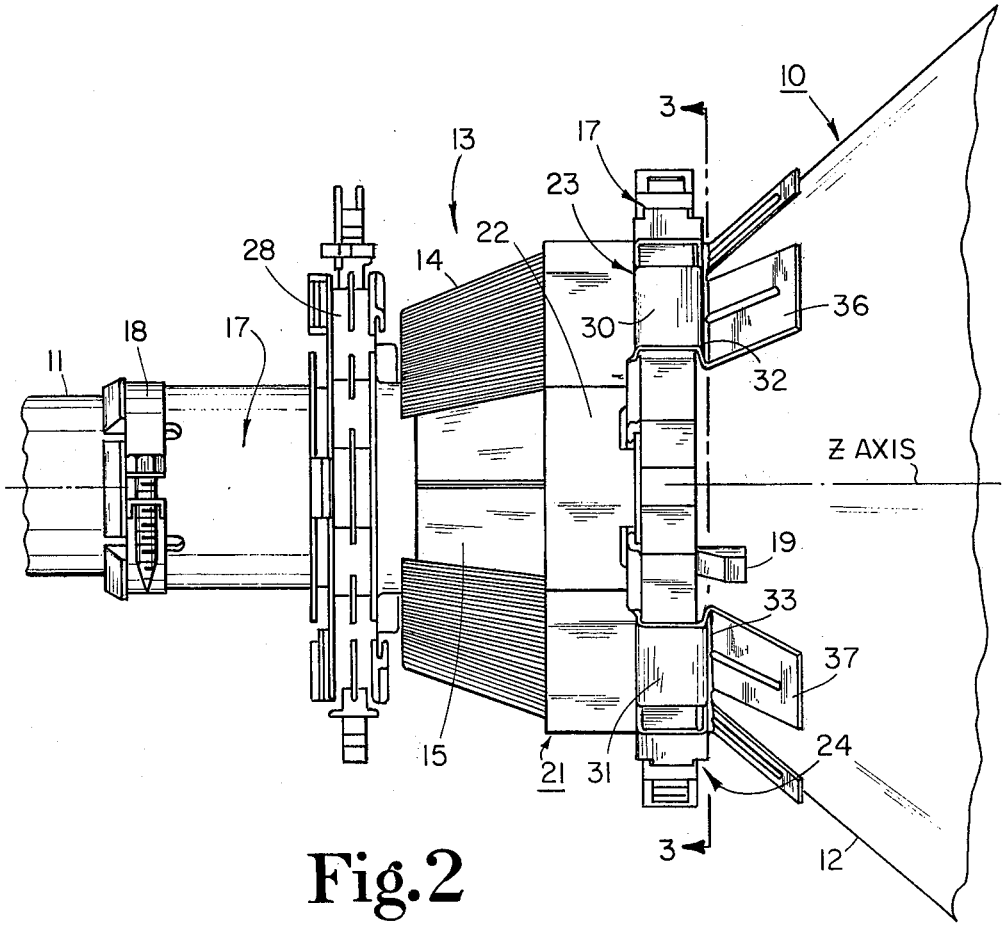
Figure 3:
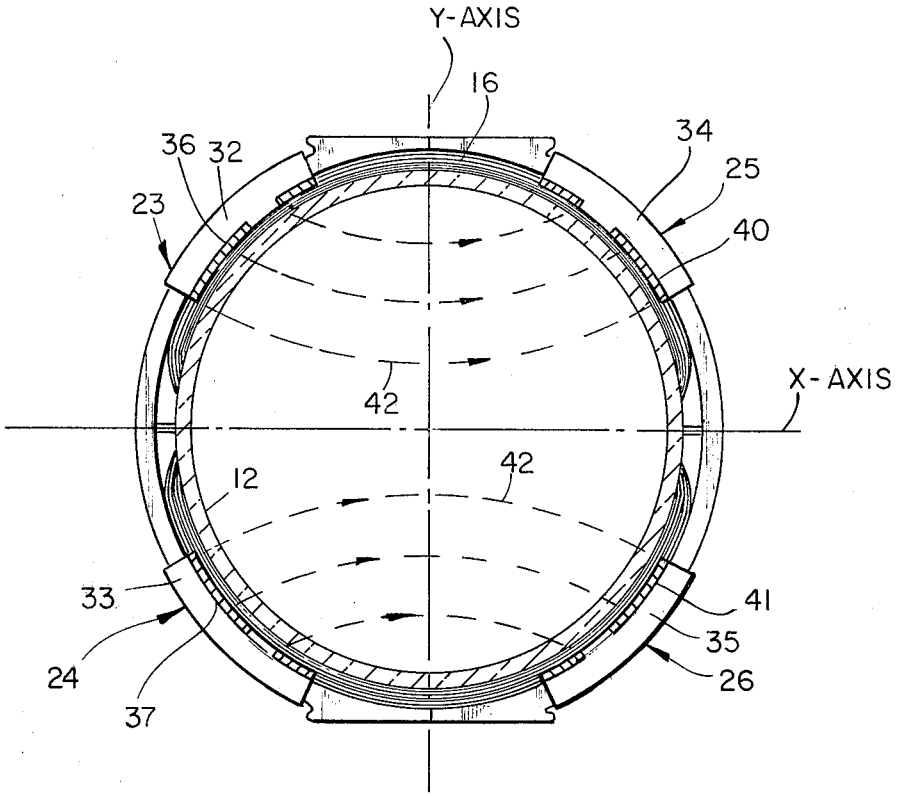

FIG. 1 shows a display screen on which is illustrated the outline of a raster; and FIG. 2 is a side elevational view of a television display system incorporating a field shaping apparatus constructed in accordance with the present invention; and FIG. 3 is a front elevational cross-sectional view of the television display system shown in FIG. 2, taken along line 3—3, illustrating representative lines of the field produced by the field shaping apparatus.

Referring to FIG. 1, there is shown a representation of the front panel 8 of a television picture tube or kinescope, including a display screen on which is illustrated the outline of a raster 9, scanned by one or more electron beams originating from an electron gun assembly located in the neck of the kinescope. The radius of curvature of the kinescope front panel 8 is greater than the distance from the electron beam deflection center to the front panel 8 so that the electron beams traverse a greater distance to the corners of the display screen than to the top, bottom and sides of the screen. This causes the scanned raster 9 to appear inwardly bowed or pincushion shaped, resulting in distortion of vertical lines in a displayed video image.

As previously described, it is possible to correct this pincushion raster distortion by providing a pincushion shaped (in the X-Y coordinate plane) deflection field near the front of the yoke. Top and bottom pincushion distortion may be corrected by modifying the horizontal deflection field, while side pincushion distortion is corrected primarily by modifying the vertical deflection field.

As previously described, the horizontal deflection field is required to have an overall net pincushion shape or nonuniformity for proper beam convergence. Top and bottom pincushion distortion correction is therefore relatively easily accomplished via the winding distribution of the horizontal deflection coils. The vertical coils, on the other hand, which are required to produce a net overall barrel shaped deflection field for beam convergence, are not so easily modified for side pincushion correction.

The vertical deflection coils are typically wound in a toroidal manner about a magnetically permeable core. This type of winding produces a great deal of stray or leakage flux along the outside of the yoke. An external field modifier, such as is disclosed in previously described U.S. Pat. No. 4,257,023, which redistributes this stray flux in a desirable manner, may be used to provide side pincushion distortion correction. The device described in U.S. Pat. No. 4,257,023 by itself may not provide a sufficient degree of field nonuniformity or the field provided may be of insufficient intensity to supply the amount of side pincushion correction needed without additional receiver circuit or yoke modifications.

In accordance with an aspect of the present invention, FIG. 2 illustrates a portion of a television display system incorporating an external field modifier which provides side pincushion raster distortion correction without the need for additional circuit or yoke modifications.

Referring to FIGS. 2 and 3, a television kinescope 10 includes a neck 11 and funnel 12. A deflection yoke 13 is mounted on kinescope 10 in the vicinity of the transition region between the neck 11 and the funnel 12 via a clamp 18 and adjusting wedge 19, of which one is shown. Deflection yoke 13 comprises a pair of vertical deflection coils 14, each toroidally wound on one half of a magnetically permeable core 15. Yoke 13 also comprises a pair of saddle-type horizontal deflection coils 16 (shown in FIG. 3) located adjacent to kinescope 10. A plastic insulator 17 separates the vertical and horizontal deflection coils from each other and may provide alignment and support structure not generally illustrated for the coils and the core. Structure 28 of insulator 17 provides means for mounting electrical terminal connectors for the yoke.

An external field modifier comprises a pair of field forming members located near the front of deflection yoke 13. The field forming members, of which only one field forming member 21 is shown in FIG. 2, are located along the sides of deflection yoke 13. Field forming member 21 comprises a flux gathering member 22, which is located to be within the external stray or leakage field produced by the vertical deflection coils 14. Field forming member 21 is made of a high permeability material and is preferably made of a single piece of sheet metal, such as silicon steel, which provides a low reluctance path for the flux of the vertical stray or leakage field. Flux gathering member 22 is desirably located close to core 15 to enable a large amount of leakage flux to flow in the flux gathering members. In FIG. 2, flux gathering member 22 is shown as bridging the two halves of core 15.

A pair of flux channeling members 23 and 24 extend from flux gathering member 22 toward the front of deflection yoke 13. Corresponding flux channeling members 25 and 26 of the field forming member located on the opposite side of yoke 13 are shown in FIG. 3. The flux channeling members are initially angled away from coils 14 of deflection yoke 13 in order to enable portions 30 and 31 of flux channeling members 23 and 24, which extend substantially parallel to the longitudinal or Z-axis of the kinescope, to pass the enlarged front end of yoke insulator 17 which encloses the end return winding of horizontal deflection coils 16. Portions 32 and 33 of flux channeling members 23 and 24 extend from the end of flux channeling portions 30 and 31 in a direction transverse or perpendicular to the kinescope longitudinal or Z-axis, toward the funnel 12 of kinescope 10. Corresponding transverse flux channeling portions 34 and 35 of flux channeling members 25 and 26 are shown in FIG. 3. Flux channeling portions 32, 33, 34 and 35 each terminate adjacent to funnel 12.

Flux directing members 36 and 37 extend from the end of flux channeling portion 32 and 33, respectively, along the surface contour of the funnel 12. Flux directing members 40 and 41 correspondingly extend from the ends of flux channeling portions 34 and 35, respectively. The flux channeling members 23, 24, 25 and 26 act as a conduit to channel flux from their associated flux gathering member (such as flux gathering member 22) to the flux directing members 36, 37, 40 and 41. The flux present in the flux directing members passes between flux directing members 36 and 40 and between flux directing members 37 and 41 to form an electromagnetic field within the interior of kinescope 10 as shown in FIG. 3. This field, illustrated by field lines 42, extends for a given instant, from one side of the yoke to the other, and has a pincushion shaped nonuniformity in the X-Y coordinate plane which, as described, provides desired side pincushion distortion correction.

The unique structure of the field forming members, such as field forming member 21, and in particular the transverse portions 32, 33, 34 and 35 of flux channeling members 23, 24, 25 and 26, not shown in U.S. Pat. No. 4,257,023, advantageously results in the flux directing members 36, 37, 40 and 41 being as close as practicable to the funnel 12 of kinescope 10, so that the respective members 36 and 40, and members 37 and 41 are as close as practicable to each other. This results in a significant increase in the intensity of the field produced within kinescope 10, as compared to a field forming structure which does not incorporate transverse flux channeling portions. The increase in field intensity increases the amount of pincushion distortion correction available.

The size and shape of the flux directing members 36, 37, 40 and 41 may be formed such as is shown, for example, in FIG. 2, in order to tailor the characteristics of the generated pincushion distortion correcting field for optimum correction at all points on the raster. For illustrative purposes, it has been found for a 90° deflection yoke having a core length of the order of 1.100 inches, flux channeling portions 30 and 31 have a length of the order of 0.400 inches, flux channeling portions 32, 33, 34 and 35 each have a length of the order of 0.180 inches, and flux directing members 36, 37, 40 and 41 each have a length of the order of 0.750 inches.

The field forming members may be attached to the insulator of the yoke, for example, by adhesive or by pins or tabs formed as a part of the insulator which interact with slots or holes formed in the field forming members.

What is claimed is:

1. A television display system comprising:

a kinescope incorporating a neck, an electron gun assembly for producing an electron beam located within said neck, a display screen, and a funnel located intermediate said neck and said display screen;

a deflection yoke mounted on said neck of said kinescope and incorporating horizontal and vertical deflection coils adapted for coupling to a source of deflection signals for forming deflection fields within said deflection yoke for deflecting an electron beam to form a raster on said display screen and forming stray fields external to said deflection yoke; and a field shaping apparatus comprising:

magnetically permeable flux gathering members disposed on opposite sides of said deflection yoke and located within the region of said stray fields for providing a low reluctance path for the flux of said stray fields;

magnetically permeable flux directing members extending along and adjacent to the surface of said funnel of said kinescope for forming an electromagnetic field within the interior of said kinescope between respective ones of said flux directing members for influencing the motion of said electron beam; and magnetically permeable flux channeling members coupled between said flux gathering members and said flux directing members for providing a low reluctance path from said flux gathering members to said flux directing members, each of said flux channeling members incorporating a first portion extending generally along the longitudinal axis of said kinescope and a transverse portion extending generally perpendicular with respect to said longitudinal axis of said kinescope, said transverse portion extending inwardly toward said kinescope and terminating adjacent to said funnel of said kinescope so as to intensify said field formed within the interior of said kinescope between said respective ones of said flux directing members.

2. The arrangement defined in claim 1, wherein said flux gathering members are located within the stray fields of said vertical deflection coils.

3. The arrangement defined in claim 1, wherein a significant part of said electromagnetic field formed between respective ones of said flux directing members is located in the vicinity of said electron beam.

4. The arrangement defined in claim 3, wherein said electromagnetic field has a pincushion shaped nonuniformity.

5. The arrangement defined in claim 3, wherein said electromagnetic field corrects side pincushion distortion of said raster on said display screen.

6. The arrangement defined in claim 1, wherein said field shaping apparatus is manufactured of silicon steel.

7. A deflection yoke incorporating horizontal and vertical deflection coils adapted for coupling to a source of deflection signals for forming deflection fields within said deflection yoke and forming stray fields external to said deflection yoke, comprising:

a field shaping apparatus comprising:

magnetically permeable flux gathering members disposed on opposite sides of said deflection yoke and located within the region of said stray fields for providing a low reluctance path for the flux of said stray fields;

magnetically permeable flux directing members disposed at the front of said deflection yoke for forming an electromagnetic field between respective ones of said flux directing members located on opposite sides of said deflection yoke; and magnetically permeable flux channeling members coupled between said flux gathering members and said flux directing members for providing a low reluctance flux path from said flux gathering members to said flux directing members, each of said flux channeling members incorporating a first portion extending generally along the longitudinal axis of said deflection yoke and extending to the front of said yoke and a transverse portion extending generally perpendicular with respect to said longitudinal axis of said deflection yoke, said transverse portion extending inwardly toward said deflection yoke longitudinal axis so as to provide an intensified field between said respective ones of said flux directing members.

* * * * *